US007934385B2

(12) United States Patent
Chen

(10) Patent No.: US 7,934,385 B2
(45) Date of Patent: May 3, 2011

(54) THERMO-ELECTRIC DEFROSTING SYSTEM

(75) Inventor: Lei Chen, South Windsor, CT (US)

(73) Assignee: Carrier Corporation, Farmington, CT (US)

( * ) Notice: Subject to any disclaimer, the term of this patent is extended or adjusted under 35 U.S.C. 154(b) by 518 days.

(21) Appl. No.: 11/990,347

(22) PCT Filed: Aug. 12, 2005

(86) PCT No.: PCT/US2005/028863

§ 371 (c)(1),
(2), (4) Date: Feb. 12, 2008

(87) PCT Pub. No.: WO2007/021270

PCT Pub. Date: Feb. 22, 2007

(65) Prior Publication Data

US 2009/0249795 A1 Oct. 8, 2009

(51) Int. Cl.
*F25B 21/02* (2006.01)

(52) U.S. Cl. ..... 62/3.6; 62/3.3

(58) Field of Classification Search ..... 62/3.2, 62/3.3, 3.6

See application file for complete search history.

(56) References Cited

U.S. PATENT DOCUMENTS 4,191,024 A * 3/1980 Machida ..... 62/80
4,586,342 A * 5/1986 Morishita et al. ..... 62/3.4
4,764,193 A 8/1988 Clawson ..... 62/3
4,879,879 A * 11/1989 Marsala et al. ..... 62/202
6,266,963 B1 * 7/2001 Rudick ..... 62/6

FOREIGN PATENT DOCUMENTS

CN 1078796 A 4/1997
JP 9-96484 A 4/1997
JP 10-148453 A 6/1998

OTHER PUBLICATIONS

International Search Report issued Jul. 1, 2008 by the ISA/US for the corresponding PCT application PCT/US2005/028863.
China Office Action, issued Nov. 20, 2009.

* cited by examiner

*Primary Examiner* — Melvin Jones
(74) *Attorney, Agent, or Firm* — Cantor Colburn LLP

(57) ABSTRACT

A refrigeration unit (40) having a defroster (30) has a refrigeration compartment (44), an evaporator coil (26) having an amount of crystallized water being aggregated thereon from air and a thermo-electric module (32, 46, 48, 50) having a semiconductor material. The thermo-electric module (32, 46, 48, 50) provides heating from a first location of the thermo-electric module (32, 46, 48, 50) and cooling from a second location of the thermo-electric module (32, 46, 48, 50) based on a Peltier effect when a current from a power supply is traversed through the thermo-electric module (32, 46, 48, 50). The heating from a first location heats the evaporator coil (26) to defrost the aggregated amount of crystallized water thereon. The cooling from the second location is communicated to the refrigeration compartment (44).

18 Claims, 5 Drawing Sheets

THERMO-ELECTRIC DEFROSTING SYSTEM

BACKGROUND OF THE INVENTION

1. Field of the Invention

The present invention relates to a defroster for a refrigeration system.

2. Description of the Related Art

Defrosting systems are known in the art. Water based material such a cool vapor, ice or frost aggregates on refrigeration components of merchandisers such as food and beverage display cases in a supermarket. This is a very well known problem in the art, and even more so today with rising energy costs. For the purposes of this application the term frost will also encompass ice or ice like material, snow or snow like material, or cooled water or water vapor, or any deposit (regardless of amount) of minute ice crystals formed when water vapor condenses at a temperature below or at freezing.

Frost from water vapor typically aggregates on an evaporator coil and forms a coating. This coating is detrimental to overall cooling capacity and efficiency of the refrigeration device and must be removed to ensure proper operation of the refrigerator. In commercial supermarkets, the defrosting devices of a low temperature (10 F.-35 F.) refrigeration system have to be actuated for up to two hours a day to remove the frost and ice by heating them. This causes productivity losses and unnecessarily warms the food therein causing possible shorter shelf life or even in the most extreme instances spoilage. Moreover, this causes a messy working condition as water collects at the floor that is mopped.

One such defrosting device that is well known in the art is a resistance heater. Another major defrosting method is to bring a hot gas ejected by the condenser units of a refrigeration system to the evaporator coil. These methods for defrosting are effective in the art, however, both of them often heat not only the evaporator coil but the food or products in the refrigeration compartment an amount. This slight increase in temperature negatively effects shelf life of the stored products. Additionally, extra piping and plumbing is needed for bringing the ejected hot gas from a condenser to a refrigeration system such as a display case. This increases the installation cost for a supermarket.

Also, the hot gas defrosting systems are often a stand alone unit. The condensers in outdoors are located a distance away from the refrigerator. Such an arrangement is not advantageous. Floor space is lost by having additional piping and extra energy is consumed by pumping the hot gas from a distant condenser. Therefore, there is a need for an integrated defrosting unit.

Another drawback of the defrosting devices of the prior art is that they are actuated to "on" for a fixed amount of time. Since the humidity of a supermarket may vary from time to time the amount of ice or frost formed on an evaporator coil and the formation rate would vary accordingly. To activate the defrost devices during a fixed period of time in a day it is likely that the defrosting does not take place when it is most needed and the defrosting process has to be excessive to avoid insufficient frost and ice removal. Again, arbitrary defrosting leads to a slight increase in temperature, which negatively effects a shelf life of the stored products and in the most extreme cases results in spoilage. Thus, there is a need in the art for an automatic defrosting unit.

Still another drawback of the defrosting devices of the prior art is that they are non-productive and cause energy losses. Often, the defrosting device generates a great amount of heat. This heating effect must be later compensated by the refrigeration device once defrosting concludes. The removal of this heat arising from defrosting exerts extra load to the condenser units, which once again leads to lower energy efficiency. This heating and then cooling causes higher energy costs. Again, this heating may cause further losses by heating the products and thereby lessening the shelf life. Thus, there is a need in the art for a localized defrosting that will not extend excessive heat into any other refrigeration components, let alone any food compartment. A thermoelectric cooling/heating device is based on the Peltier effect, which moves heat from one location to another when a current flows through certain semiconductor materials. The thermoelectric modules are operated using direct current that is optimized to gain the best coefficient of performance (COP). The cooling COP of a thermoelectric device operated at its optimal current is given as equation (1).

$$\phi_c = \frac{T_c}{(T_h - T_c)} \frac{[(1 + ZT_M)^{1/2} - T_h/T_c]}{[(1 + ZT_M)^{1/2} + 1]} \qquad \text{equation 1}$$

where Z is the figure of merit, a material property, $T_M$ is the average temperature of a heat sink and a heat source, and $T_c$ and $T_h$ are the temperatures of a heat source (cold side) and a heat sink (hot side) respectively. The COP for heating is simply the cooling COP plus one. This is given as $$\phi_h = 1 + \frac{T_c}{(T_h - T_c)} \frac{[(1 + ZT_M)^{1/2} - T_h/T_c]}{[(1 + ZT_M)^{1/2} + 1]} \qquad \text{equation 2}$$

which is always greater than 1. The energy balance for a thermoelectric module is given as $$Q_h = W_e + Q_c \qquad \text{equation 3}$$

where $Q_h$ is the heating energy generated, $W_e$ is the electrical energy input which equals $I^2R$ (I-current, R-resistance of a thermoelectric module), and $Q_c$ is the cooling absorbed from the immediate environment. The heating COP is related to these energy terms by $$\phi_h = \frac{Q_h}{W_e} \qquad \text{equation 4}$$

Therefore, to yield a same amount of localized heating $Q_h$ a thermoelectric device would consume $(1-1/\phi_h)Q_h$ less electrical energy than a conventional resistive heater. Furthermore, a net global heating effect made by a thermoelectric device is also $(1-1/\phi_h)Q_h$ less than that an amount generated by a prior resistive heater which is about equal to $Q_h$. Thermoelectric heating benefits the minimization of excessive heating.

Accordingly, there is a need for a cooling system and defrosting system for a refrigeration unit that does not overly heat the refrigeration compartment. There is also a need for a defrosting system that is a compact unit that may be easily manufactured and easily installed in an existing or new system. There is still another need for a defroster that automatically senses the presence of frost, water vapor, ice, snow and automatically defrosts or otherwise removes the material for an optimal operation and an automatic modulation. There is a further need for a defroster that also provides cooling to assist the refrigeration device.

There is also a need for such a defroster that eliminates one or more of the aforementioned drawbacks and deficiencies of the prior art.

SUMMARY OF THE INVENTION

It is an object of the present invention to provide a device that defrosts a component and also provides cooling to a compartment.

It is another object of the present invention to provide a device that forms a tube having an interior and an exterior with the interior having a coolant traversing therethrough for cooling the coolant and communicating the coolant to a compartment and the exterior of the tube simultaneously defrosting a refrigeration component.

It is yet another object of the present invention to provide a device for defrosting an evaporator that does not overly warm a refrigeration compartment.

It is still another object of the present invention to provide a defroster that automatically senses frost and heats the frost in response thereto.

It is still yet another object of the present invention to provide a device for defrosting that automatically or periodically defrosts a refrigeration component.

It is a further object of the present invention to provide a defroster having a thermo-electric module.

It is a further object of the present invention to provide a defroster having a plurality of thermo-electric modules.

It is a further object of the present invention to provide a defroster that may be integral with a refrigerator unit.

It is a further object of the present invention to provide a defroster that may be retrofit to a refrigerator unit.

It is a further object of the present invention to provide a defroster that is not a stand alone unit relative to a refrigerator unit.

These and other objects and advantages of the present invention are achieved by a refrigeration unit of the present invention. The refrigeration unit has a defroster and has a refrigeration compartment and an evaporator coil having an amount of crystallized water being disposed. The evaporator coil is for cooling the refrigeration compartment. The unit also has a thermo-electric module having semiconductor materials with the thermo-electric module providing heating from a first location of the thermo-electric module and cooling from a second location of the thermo-electric module based on the Peltier effect when a current from a power supply is traversed through the module. The heating from the first location heats the evaporator coil to defrost the amount of crystallized water thereon. The cooling from the second location is communicated to the refrigeration compartment.

DETAILED DESCRIPTION OF THE INVENTION

Figure 1:
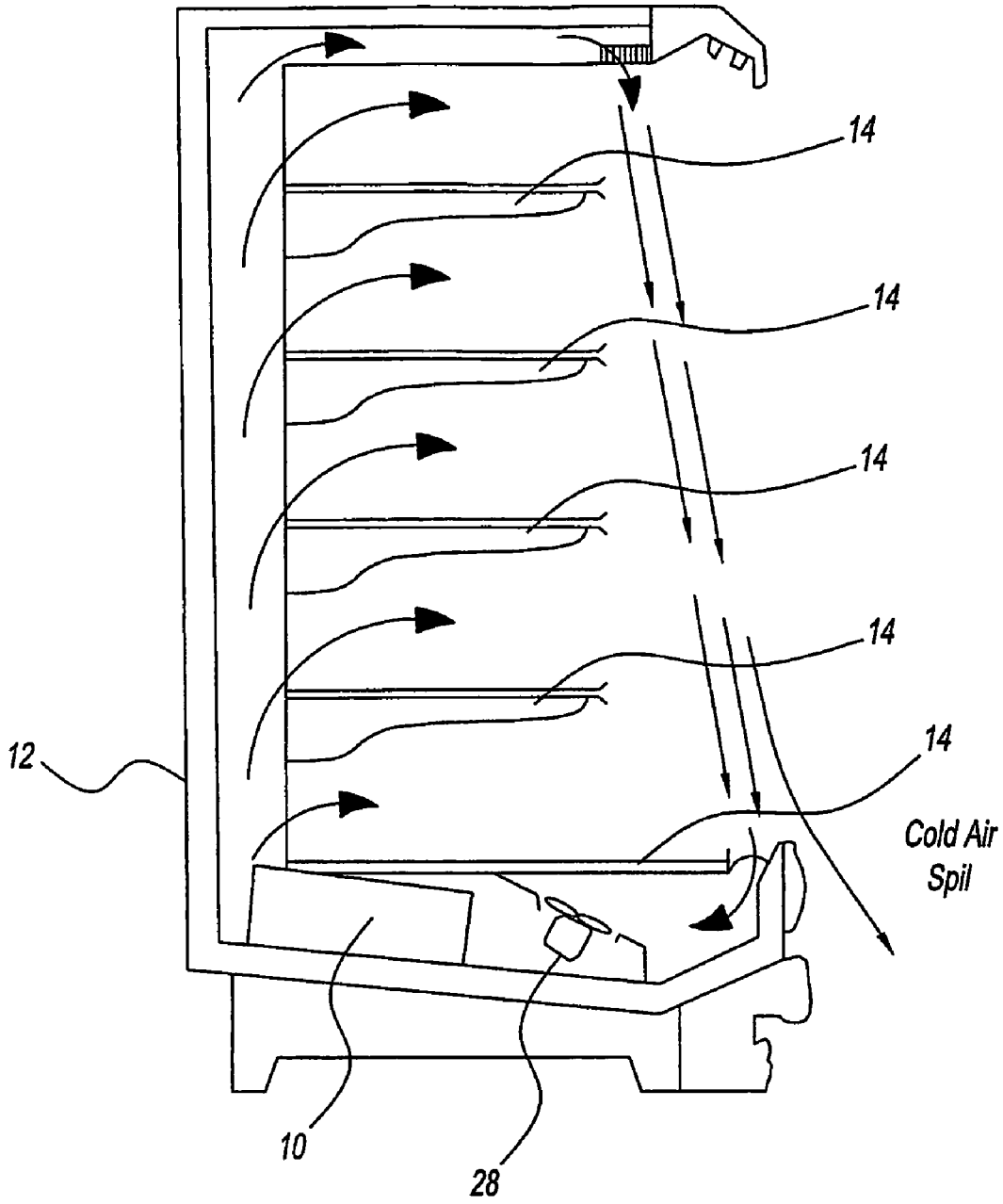
FIG. 1 is a side view of an existing refrigeration unit.
Figure 2:
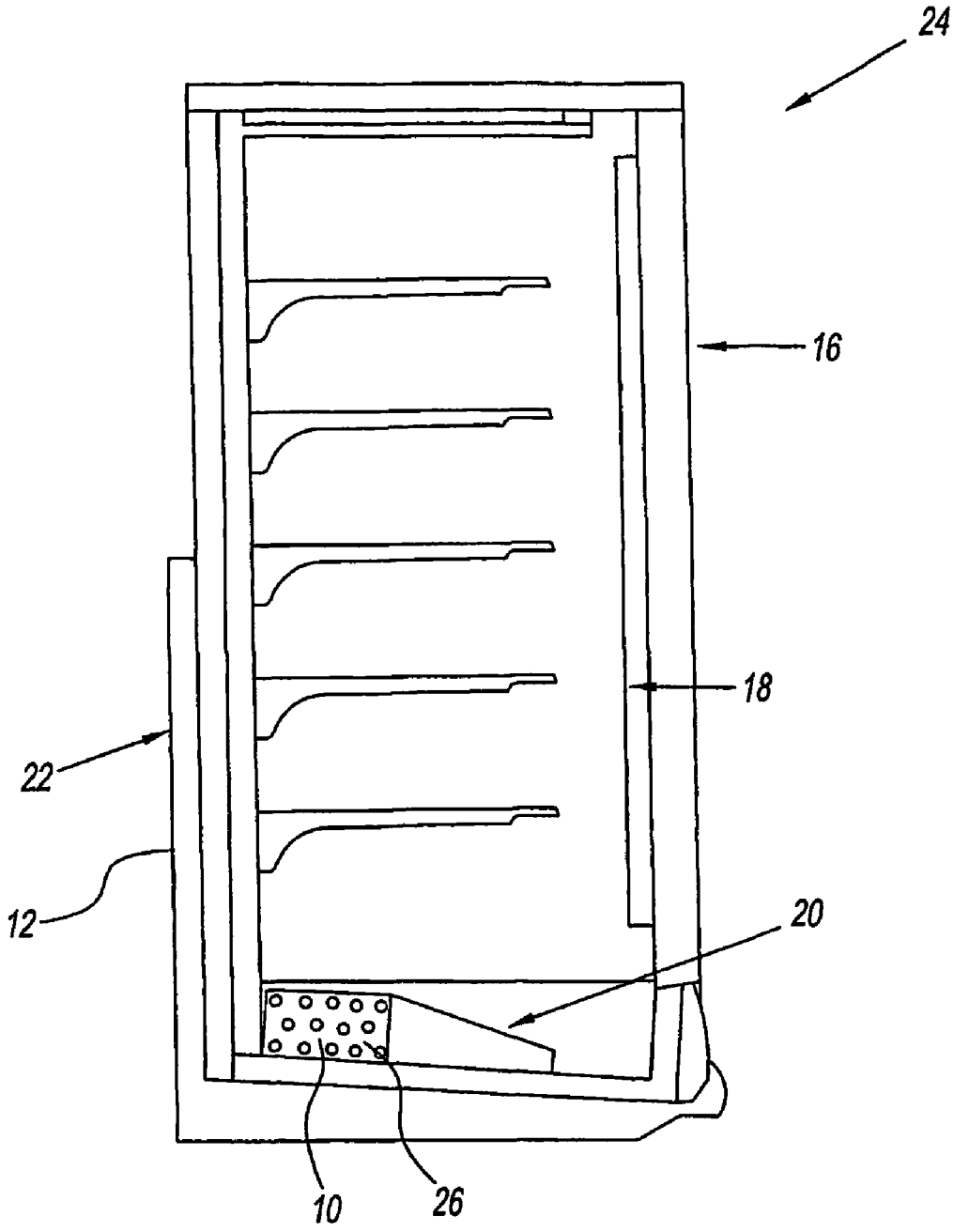
FIG. 2 is a side view of another refrigeration unit having a case.

Referring to FIGS. 1 and 2, shown are refrigerator units of the prior art having a cooling device 10 and a housing 12. Referring to FIG. 1, the housing 12 has a number of shelves 14 therein for storing products such as milk, cheese, eggs, food, liquids, solids, beverages and any other foods, products, or spoilable items that are known in the art.

Referring to FIG. 2, the refrigeration unit may have a door 16, lighting 18, a drain pan 20 and insulation 22 as is well known in the art. In both FIGS. 1 and 2, the refrigerator unit 24 preferably has a fan and a condenser (not shown) that are connected to the refrigeration unit and a cooling unit that has an evaporator coil 26 therein. The evaporator coil 26 is for a vapor compression cycle of the refrigeration unit 24 and has a throttling valve that expands a refrigerant. Once expanded, the refrigerant has a lower a boiling point. To commence a boil, the refrigerant draws heat from the ambient to boil thus causing cooling to occur as is well known in the art.

One aspect of the cooling device 10 is that the cooling coil of the evaporator or evaporator coil will accumulate a water vapor. The water vapor is in the air that is blown or traverses thereby from a fan 28 as shown in FIG. 1. This water vapor deposits itself on the cool evaporator coil 26 and creates frost or small minute crystals of ice.

Figure 3:
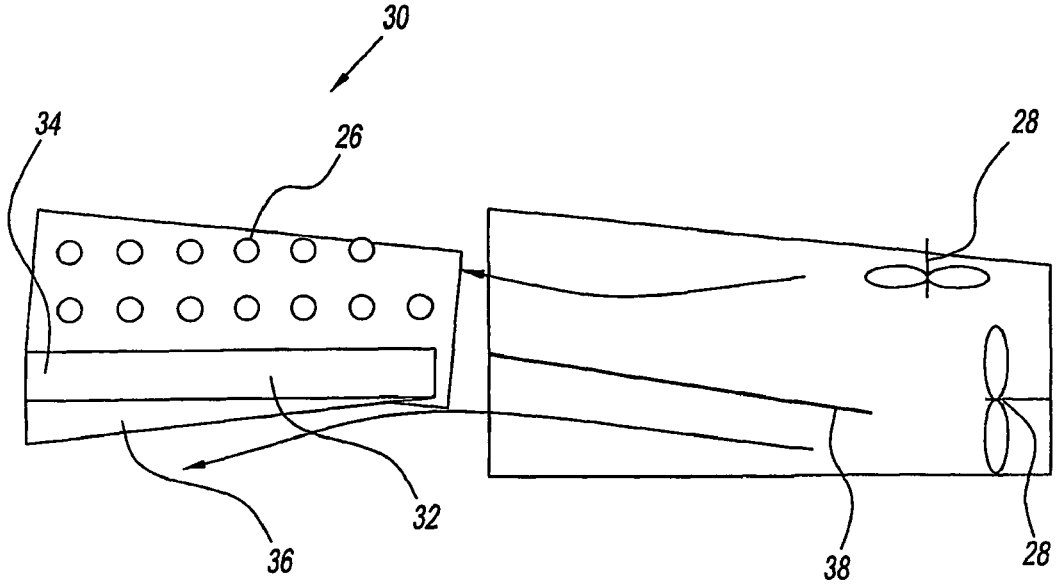
FIG. 3 is a side view of a defroster unit of the present invention.

Referring to FIG. 3, the defroster 30 of the present invention preferably remedies this known problem in the art in an unexpected and superior manner relative to the prior art resistance heaters. The defroster 30 has a thermo-electric device 32 that is connected to a power supply. The thermo-electric device 32 is a solid state device and operates based on the Peltier effect and is well known in the art. The thermo-electric device 32 has a heat transfer associated with a free charge carrier movement and has a p type semiconductor material and an n type semiconductor material. Once current traverses through the thermo-electric device 32 one side will become heated 34 and the other opposite side 36 will become colder and is well known in the art.

Referring still to FIG. 3 first side 34 emits heat and is in contact with the evaporator coil 26. In this manner, the thermo-electric module 32 heats and thus defrosts the evaporator coil 26. Concurrently, second side 36 draws heat. The unit 30 further has a fan 28 for blowing the air past the second side 36 to transfer the heat in the air into the thermo-electric module through the surface of 36 and then communicates cool air to the compartments. The second side 36 preferably has a profiled surface. The profiled surface allows the air to contact the thermo-electric module 32 and enhances heat transfer.

The defroster 30 further has a damper 38. The damper 38 is movable from a first position to a second position and preferably ensures an optimal defrosting effect by dividing the air traversing the cold plate 36 of the thermoelectric defroster 32 and that traversing the evaporator coil being defrosted. The damper 38 maintains refrigeration of the products in the compartment by modulating a flow of the air from the fan 28. The defroster 30 further has a sensor (not shown). The sensor may be any sensor known in the art such as an optical sensor or any device for sensing a condition of the evaporator coils 26 or other components and then actuating the defroster 30 in response thereto. Preferably, the sensor is disposed close to, on or in the evaporator coils 26 for obtaining a reading of the condition thereon for a real time defrosting.

Alternatively, the defroster 30 may be manually or automatically actuated or periodically operated for a predetermined time frame such as once or a number of times per day for a preset time frequency. This may be based on a size of the refrigeration unit. The defroster 30 may be activated from a remote location, a location in the store, via the internet or from a control panel connected to the defroster.

Figure 4:
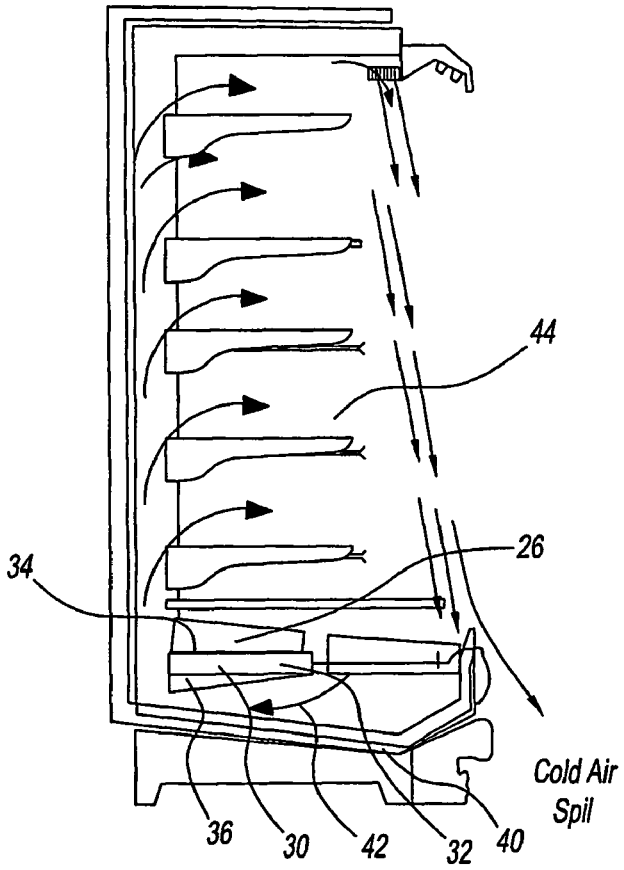
FIG. 4 is a side view of the defroster unit in the refrigeration unit of FIG. 1.

Referring now to FIG. 4, there is shown the defroster 30 in the refrigeration unit 40. As shown, the defroster 30 is a compact structure and is placed in a complementary location to the evaporator coils 26. As is shown, the unit 30 has a path 42 to allow the cool air from the second side 36 of the thermo-electric module 32 to communicate with the compartment 44 for increased productivity. Moreover, the first side 34 of the thermo-electric device 32 preferably generates a net heat that is only a fraction of a conventional resistive heating defroster and a hot gas defroster to effect the productivity of the unit while defrosting and exerts minimal temperature excursion for any perishable items therein. Further, the defroster 30 is very advantageous over the prior art as it extends shelf life. With the present invention, the temperature of the perishable items is not disturbed or is only negligibly disturbed. It has been observed that maintaining this static temperature of the perishable items while defrosting results in a longer shelf life. This longer shelf life is an improvement over the prior art defrosting mechanisms where perishables are often heated slightly and shelf life is greatly reduced.

Figure 5:
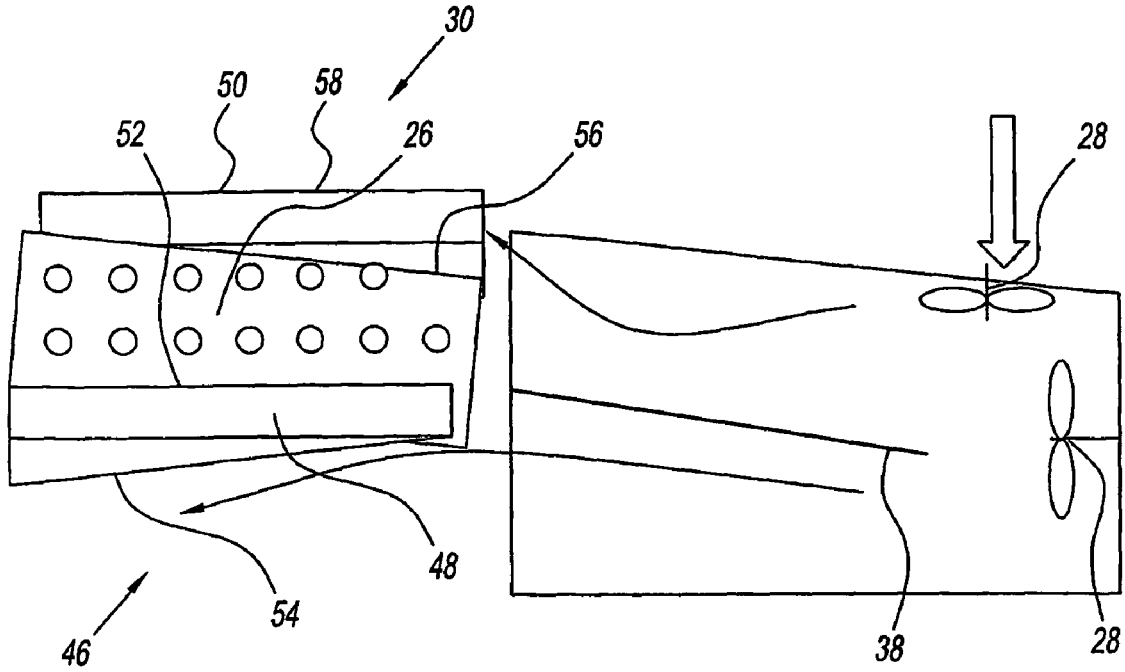
FIG. 5 is another side view of another exemplary embodiment of the defroster of the present invention and FIG. 5A is an end view of a tube in an exemplary embodiment.

Referring now to FIG. 5, there is shown another embodiment of the present invention. The defroster 30 has multiple thermo-electric devices 46 or a first thermo-electric module 48 and a second thermo-electric module 50. Although shown with two, the defroster 30 may have three, four, five, or any desired number of modules for defrosting based on the application. Preferably, the first thermo-electric device 48 has a first heating side 52 and a second cooling side 54 and is connected to a power source (not shown). The second thermo-electric device 50 has a first heating side 56 and a second cooling side 58. Preferably, the first heating side 52 of the first thermo-electric device 48 faces the evaporator coil 26 and the first heating side 56 of the second thermo-electric device 50 also faces the evaporator coil that is between the first and the second thermo-electric devices. In this manner, the heat from the first and the second thermo-electric devices 48, 50 defrosts the evaporator coil 26 from multiple sides. Again, the second cooling side 58, 54 of both the first and the second thermo-electric devices 48, 50 preferably cool air that communicates with the compartment as shown previously. Additionally, the thermo-electric module in another embodiment may have a profile surface 52 and 56 with water drain function to assist with collection of the melted liquid to prevent spillage.

Figure 6:
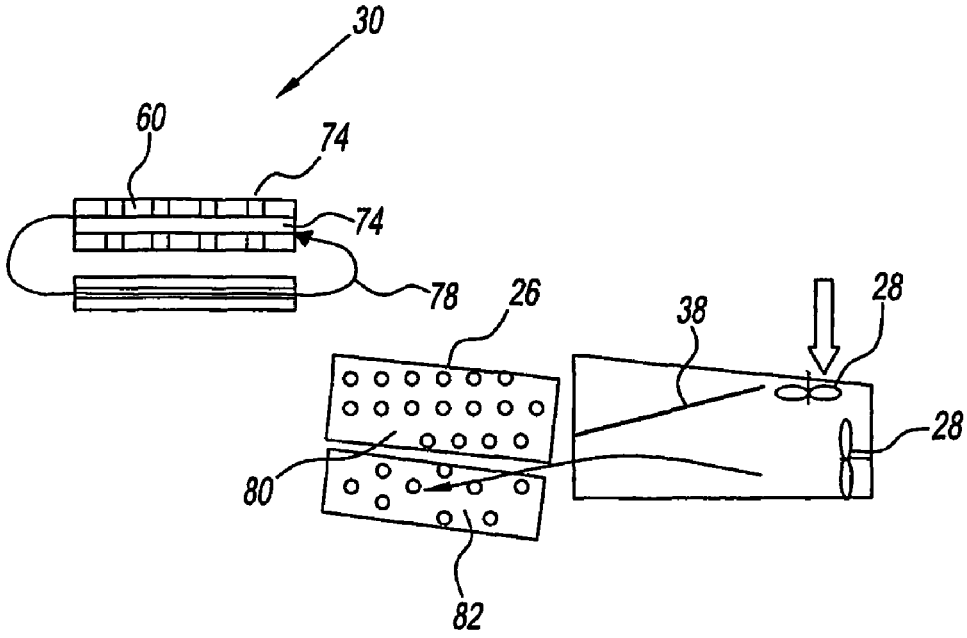
FIG. 6 is still yet another side view of another embodiment of the defroster of the present invention.
Figure 6A:
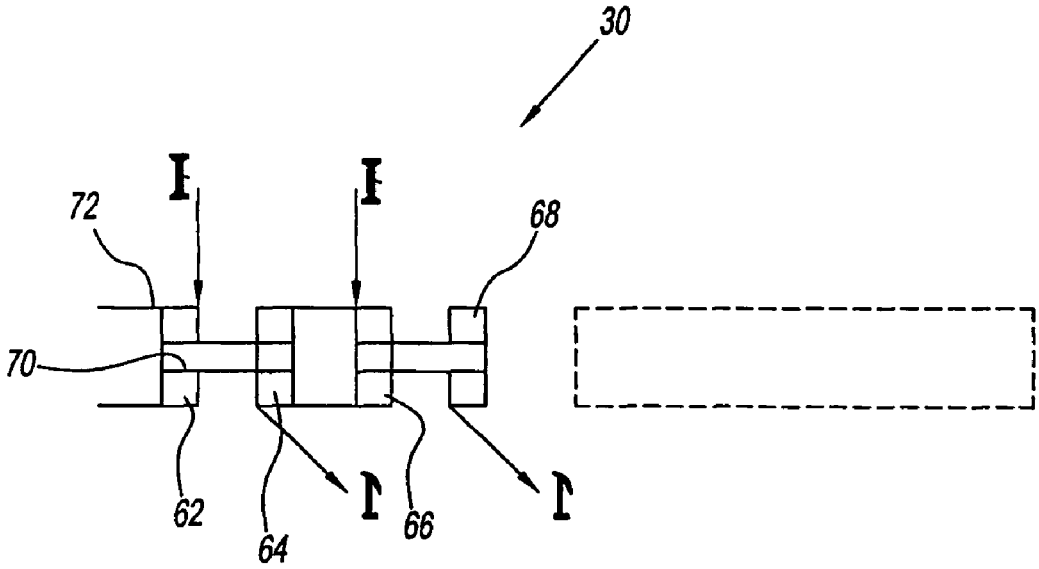
FIG. 6A shows a cross sectional view along line 5-5 of FIG. 6.

Referring to FIG. 6, there is shown another embodiment of the defroster 30 of the present invention. Preferably, the defroster 30 is formed in a tube 60 as shown in cross section. Preferably, as shown in FIG. 6A in this embodiment, the defroster 30 is made from a number of rings 62, 64, 66, 68 of p and n type semi-conductor material. Preferably, the p and n type material are each in a substantially shaped member having an interior 70 and an exterior surface 72. Although shown as ring or "O" shaped, the members or rings 62, 64, 66, 68 are not limited to this embodiment and may be polygonal, rectangular, substantially ring shaped or any shaped in the art so long as the member has the interior 70 and the exterior space 72. As shown in FIG. 6A, preferably, the p and n type materials 62, 64, 66, 68 are disposed in an alternating fashion and are connected in series by a wire to the power source (not shown). In this manner, the tube 60 collectively shown in FIG. 6, emits heat from a first exterior surface 74 and draws heat from the interior 76.

Figure 5A:
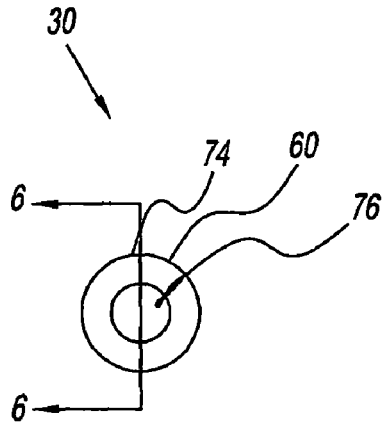

Referring to FIG. 5A, there is shown a tube 60 of the defroster 30. The defroster 30 has the interior 76 for cooling and the exterior 74 for defrosting as shown. Referring again now to FIG. 6 there is shown the tube 60 in cross section along line 6-6 of FIG. 5A. The tube 60 of the defroster 30 further has a conduit 78 that is disposed through the interior of the thermo-electric module 60 and preferably has a coolant that is disposed through the conduit. The coolant may be any coolant known in the art and is preferably an aqueous ethylene glycol. Heat is drawn from the coolant to the interior 76 and thus cooled. The coolant then circulates to cooling device 82 of the defroster unit and cools the return air that is circulated to the compartment 12 for additional cooling and preferably an increase in productivity. The defroster 30 is further advantageous because it does not need a pump to circulate the coolant and instead the conduit 78 relies on a siphon or a natural convective circulation of the coolant therein for an enhanced circulation.

Referring to FIG. 6, the defroster 30 may further have a number of heat fins 80 that are in thermal communication with the evaporator coil 26 for imparting the defrosting heat to the evaporator coil when actuated. The defroster 30 also may have one or more cooling fins 82 that are in thermal communication with the coolant in the conduit 78 for communicating this to the air that is drawn by the cooling fins. The air would then be blown back into the compartment 44 for additional cooling.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A refrigeration unit having a defroster, the refrigeration unit comprising:

a refrigeration compartment;

an evaporator coil subject to the formation of crystallized water thereon from exposure to air; and a thermo-electric module having a semiconductor material, said thermo-electric module adjacent said evaporator coil and providing heat from a first area of the thermo-electric module and cold from a second area of the thermo-electric module when a current from a power supply is traversed therethrough, wherein said heat from said first area heats said evaporator coil to defrost any aggregated amount of crystallized water on said evaporator coil and wherein said cold from said second area is communicated to said refrigeration compartment for cooling.

2. The refrigeration unit (40) of claim 1, further comprising a sensor for detecting said crystallized water, and wherein said thermo-electric module is activated in response to said detection of said sensor.

3. The refrigeration unit (40) of claim 1, further comprising a profiled surface on a first side of said thermo-electric module.

4. The refrigeration unit (40) of claim 1, further comprising a profiled surface on a second side of said thermo-electric module.

5. A refrigeration unit having a defroster, the refrigeration unit comprising:

a refrigeration compartment;

an evaporator coil subject to the formation of crystallized water thereon from exposure to air;

a thermo-electric module having a semiconductor material, said thermo-electric module adjacent said evaporator coil and providing heat from a first area of the thermo-electric module and cold from a second area of the thermo-electric module when a current from a power supply is traversed therethrough, wherein said heat from said first area heats said evaporator coil to defrost any aggregated amount of crystallized water thereon and wherein said cold from said second area is communicated to said refrigeration compartment for cooling; and a second thermo-electric module, wherein said second thermo-electric module has a heating side and a cooling side, wherein said heating side of said second thermo-electric module faces said evaporator coil.

6. The refrigeration unit of claim 5, wherein said cooling side of said second thermo-electric module is in communication with said refrigeration compartment.

7. A refrigeration unit having a defroster, the refrigeration unit comprising:

a refrigeration compartment:

an evaporator coil subject to the formation of crystallized water thereon from exposure to air; and a thermo-electric module having a semiconductor material, said thermo-electric module adjacent said evaporator coil and providing heat from a first area of the thermo-electric module and cold from a second area of the thermo-electric module when a current from a power supply is traversed therethrough, wherein said heat from said first area heats said evaporator coil to defrost any aggregated amount of crystallized water thereon and wherein said cold from said second area is communicated to said refrigeration compartment for cooling;

wherein said thermo-electric module has a plurality of looped shaped n type thermo-electric pellets and a plurality of looped shaped p type thermo-electric pellets.

8. The refrigeration unit of claim 7, wherein said plurality of looped shaped n type thermo-electric pellets and said plurality of looped shaped p type thermo-electric pellets are disposed in an alternating fashion and are electrically connected in series.

9. The refrigeration unit of claim 8, wherein said combined alternating plurality of looped shaped p type thermo-electric pellets and plurality of looped shaped n type thermo-electric pellets collectively form an interior space and an exterior space, wherein said exterior space radiates heat when current traverses through said thermo-electric module and wherein said interior space provides cooling.

10. The refrigeration unit of claim 9, wherein said radiated heat from said exterior space defrosts said crystallized water from said evaporator coil, and wherein said cooling is imparted to a coolant being brought into thermal contact with said refrigeration compartment.

11. The refrigeration unit of claim 9, wherein said interior space provides cooling when current traverses through said thermo-electric module and wherein said exterior space radiates heat for defrosting said amount of crystallized water from said evaporator coil, and wherein said cooling is imparted to a coolant being brought into thermal contact with said refrigeration compartment.

12. A refrigeration unit having a defroster, the refrigeration unit comprising:

a refrigeration compartment;

an evaporator coil subject to the formation of crystallized water thereon from exposure to air;

a thermo-electric module having a semiconductor material, said thermo-electric module adjacent said evaporator coil and providing heat from a first area of the thermo-electric module and cold from a second area of the thereto-electric module when a current from a power supply is traversed therethrough, wherein said heat from said first area heats said evaporator coil to defrost any aggregated amount of crystallized water thereon and wherein said cold from said second area is communicated to said refrigeration compartment for cooling; and a damper for controlling an air flow.

13. A defroster comprising:

a thermo-electric module having a semiconductor material, said thermo-electric module provides heating from a first area of the thermo-electric module and cooling from a second area of the thermo-electric module when a current from a power supply is traversed through said thermo-electric module, wherein said heating defrosts a desired location and wherein said cooling cools a compartment; and a further thermo-electric module having a heat radiating side and a cooling side, wherein said heating radiating side of said further thermo-electric modules faces said desired location, wherein said desired location is adjacent to an evaporator coil.

14. The defroster of claim 13, wherein said second area has a profiled surface.

15. The defroster of claim 13, further comprising a sensor for measuring a parameter of a refrigeration component, and wherein said sensor controls said thermo-electric module in response to said parameter.

16. A defroster comprising: a thermo-electric module comprising: a plurality of substantially looped shaped n type thermo-electric pellets; and a plurality of substantially looped shaped p type thermo-electric pellets, wherein said plurality of looped shaped n type thermo-electric pellets and said plurality of looped shaped p type thermo-electric pellets are disposed in an alternating fashion with at least one p type thermo-electric pellet being adjacent to at least one n type thermo-electric pellet with said plurality of looped shaped n type thermo-electric pellets and said plurality of looped shaped p type thermo-electric pellets being electrically connected in series.

17. The defroster of claim 16, wherein said plurality of looped shaped n type thermo-electric pellets and said plurality of looped shaped p type thermo-electric pellets form a tube having an exterior space and an interior space, and wherein said exterior space emits heat and wherein said interior space provides cooling.

18. The defroster of claim 17, further comprising a conduit having a coolant therein, wherein said coolant traverses through said interior space for providing cooling to another desired location.

* * * * *